US005122094A

United States Patent [19]

Abe

[11] Patent Number: 5,122,094

[45] Date of Patent: Jun. 16, 1992

[54] COIN DISPENSING APPARATUS

[75] Inventor: Hiroshi Abe, Tokyo, Japan

[73] Assignee: Asahi Seiko Kabushiki Kaisha, Tokyo, Japan

[21] Appl. No.: 712,074

[22] Filed: Jun. 7, 1991

[30] Foreign Application Priority Data

Jun. 13, 1990 [JP] Japan ..... 2-152852

[51] Int. Cl.[5] ..... G07D 1/00; G07D 9/04

[52] U.S. Cl. ..... 453/57; 221/203; 221/265

[58] Field of Search ..... 453/33, 34, 35, 57; 221/180, 182, 203, 265

[56] References Cited

U.S. PATENT DOCUMENTS 4,061,222 10/1991 Suris ..... 453/57
4,589,433 5/1986 Abe ..... 453/57
4,798,558 1/1989 Bellis ..... 453/57 X

FOREIGN PATENT DOCUMENTS 1-304595 12/1989 Japan ..... 453/57
2185341 7/1987 United Kingdom ..... 453/57

*Primary Examiner*—F. J. Bartuska
*Attorney, Agent, or Firm*—Nilles & Nilles

[57] ABSTRACT

A coin dispensing apparatus comprises a coin supply hopper secured to a base plate inclined at an angle to the horizontal and a coin feeding rotary disk rotatably supported on the base plate within the coin supply hopper. The coin feeding rotary disk has a disk body and a circumferential wall. The disk body includes a plurality of circumferentially spaced coin receiving through holes extended through the peripheral portion of the coin feeding rotary disk, and a plurality of coin feeding arms having a thickness smaller than the thickness of a coin to be treated and extending at an angle to the radial direction of the rotary disk on the peripheral portion of the bottom surface between the coin receiving through holes of the rotary disk. The disk body preferably has a sufficient thickness to provide coin receiving through holes having a deep depth for holding at least three coins therein. The circumferential wall is provided on the inner surface thereof with a plurality of circumferentially spaced coin agitating protrusions, whereby improving the coin delivery efficiency.

7 Claims, 4 Drawing Sheets

COIN DISPENSING APPARATUS

BACKGROUND OF THE INVENTION

1. Field of the Invention

The present invention relates to a coin dispensing apparatus used in coin changers, game machines or the other for delivering coins or tokens from a coin supply hopper one at a time.

2. Description of the Prior Art

Hitherto, there have been known various types of coin dispensing apparatus comprising a coin supply hopper for storing a supply of coins in bulk and a rotary disk rotatably disposed in the hopper at an angle to the horizontal and adapted for delivering coins or tokens in desired quantities from the coin supply hopper one at a time as disclosed in Japanese Patent Application Publication 55-48,634, wherein the coin feeding rotary disk is rotatably disposed within a stationary cylindrical wall on an inclined base plate at the bottom of the coin supply hopper, and provided with a plurality of circumferentially spaced coin receiving through holes and a plurality of coin feeding arms radially extending between the through holes on the lower surface of the rotary disk, and as disclosed in Japanese Patent Application Publication 62-45,588 (U.S. Pat. No. 4,589,433), wherein the coin feeding rotary disk is rotatably disposed on an inclined base plate at one side within the coin supply hopper and is provided with a plurality of circumferentially spaced coin feeding pins projected from the upper surface of the peripheral portion of the rotary disk.

The coin dispensing apparatus of the former type has disadvantages such that since it is essentially intended to make compact and small as the whole, a diameter of the coin feeding rotary disk is limited and as the result numbers of the coin receiving through holes and therefore numbers of coins to be dispensed per one revolution are limited. Furthermore, when the coins remained in the coin supply hopper decrease during rotation of the disk, coins are supported on the stational cylindrical wall at the peripheral portion of the rotating disk without entering into the coin feeding through holes so that a coin dispensing efficiency is lowered, that is a quantity of coin dispensed by one rotation of the coin feeding rotary disk is decreased.

While, the coin dispensing apparatus of the later type has a problem such that improvement of coin dispensing efficiency could not be expected by increasing of the diameter of the coin feeding rotary disk and the numbers of coin feeding pins.

SUMMARY OF THE INVENTION

The object of the present invention is to solve the above problem and to provide a new type of coin dispensing apparatus having a superior coin dispensing efficiency.

A feature of the present invention is to provide a coin dispensing apparatus comprising a coin supply hopper secured to a base plate inclined at an angle to the horizontal for storing a supply of coins in bulk and a coin feeding rotary disk rotatably supported on the base plate within the coin supply hopper, the coin feeding rotary disk having a disk body and a circumferential wall, the disk body including a plurality of circumferentially spaced coin receiving through holes extended through the peripheral portion of the coin feeding rotary disk and a plurality of coin feeding arms having a thickness smaller than the thickness of a coin to be treated and extending at an angel to the radial direction of the rotary disk on the peripheral portion of the bottom surface between the coin receiving through holes of the rotary disk, and the circumferential wall being provided on the inner surface thereof with a plurality of circumferentially spaced coin agitating protrusions.

The disk body is preferably formed by a thick plate so as to provide coin receiving through holes having a deep depth such that for example five coins can be retained in each of the through holes. The coion agitationg protrusions on the inner surface of the circumferential wall may be inwardly inclined and/or extended from the top end to the bottom end of the circumferential wall.

The inclined base plate may be provided with a supporting circular stage which is concentric with a central rotary shaft and has a thickness larger than the thickness of a coin to be treated. The coin feeding rotary disk is rotatably supported on the supporting circular stage, whereby one coin dropped through each of the coin receiving through holes can be retained on the upper coin supporting surface of the inclined base plate between the coin feeding arms extending at an angle to the radial direction across the bottom peripheral portion of the coin feeding rotary disk. The inclined base plate is provided with a coin guide elliptical plate with the large diameter end portion having a center coincided with the central axis of the coin feeding rotary disk and the small diameter end portion opposed to a coin outlet formed in the coin supply hopper. The elliptical coin guide plate has a coin outlet guide portion directed to the coin outlet for guiding coins to the coin outlet. The coin feeding arms may be extended at least from the outer peripheral edge to the circle connecting centers of the coin receiving through holes on the bottom surface of the coin feeding rotary disk, whereby coins can be effectively pushed out the coin outlet in the coin supply hopper by means of the coin feeding arms. Preferably, the coin guide plate can be selectively positioned so as to correspond position of the linear coin outlet guiding portion to coins having a large or small diameter.

The coin supply hopper has a cylindrical lower portion fitted outside of the circumferential wall of the coin feeding rotary disk and a coin outlet formed in the cylindrical lower portion at a down stream position of the coin outlet guide portion of the coin guide plate.

A pair of guide rollers may be arranged at both sides of the coin outlet respectively. One of the guide rollers is a fixed roller which is rotatably supported on a roller shaft fixed to the base plate at the upstream side of the coin outlet and other of the guide rollers is a movable roller which is rotatably supported on a roller shaft secured to an actuator of an outlet sensor at the downstream side of the coin outlet.

With the above arrangement, a number of coins in the coin supply hopper are effectively agitated by the agitating protrusions on the inner surface of the circumferential wall which is integrally rotated with the coin feeding rotary disk without any slippage of coins along the circumferential wall and a plurality of coins, such as five coins are received at the same time by the coin receiving through hole. Therefore, coins can be continuously dispensed even if the coin feeding rotary disk is rotated at a high speed so that the coin delivery efficiency can be greatly improved.

DESCRIPTION OF THE DRAWINGS

Further object and advantages of the invention will become apparent as the following description of an illustrative embodiment proceeds with reference to the drawings in which.

DESCRIPTION OF THE PREFERRED EMBODIMENT

Figure 1:
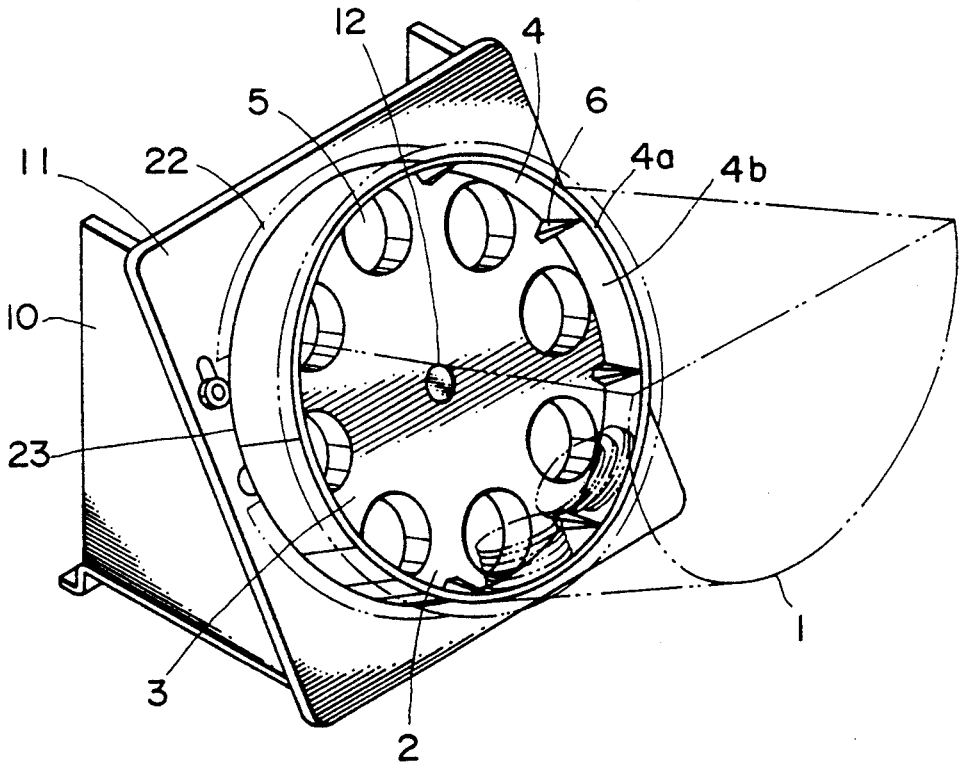
FIG. 1 is a schematic perspective view illustrating an embodiment of the coin dispensing apparatus according to the present invention.

Referring to drawings illustrating an embodiment according to the present invention, a coin supply hopper 1 is mounted on a supporting base plate 11 supported at about 60° angle to the horizontal by a supporting frame 10. A coin feeding rotary disk 2 is rotatably supported on the inclined base plate 11 at one side within the coin supply hopper 1 and connected to central rotary shaft 12.

Figure 3:
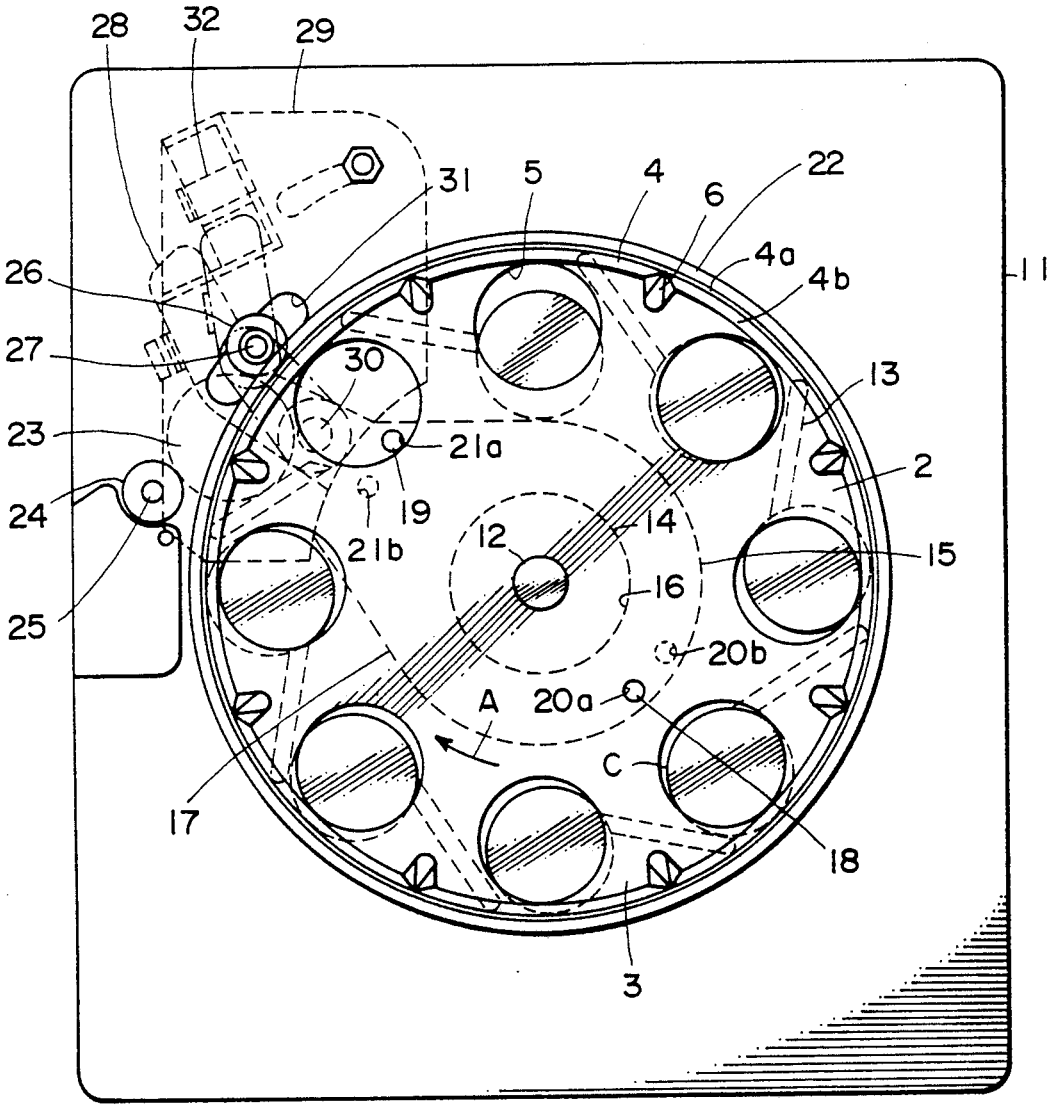
FIG. 3 is a view showing a coin feeding rotary disk assembled on an inclined base plate without a coin supply hopper.
Figure 4:
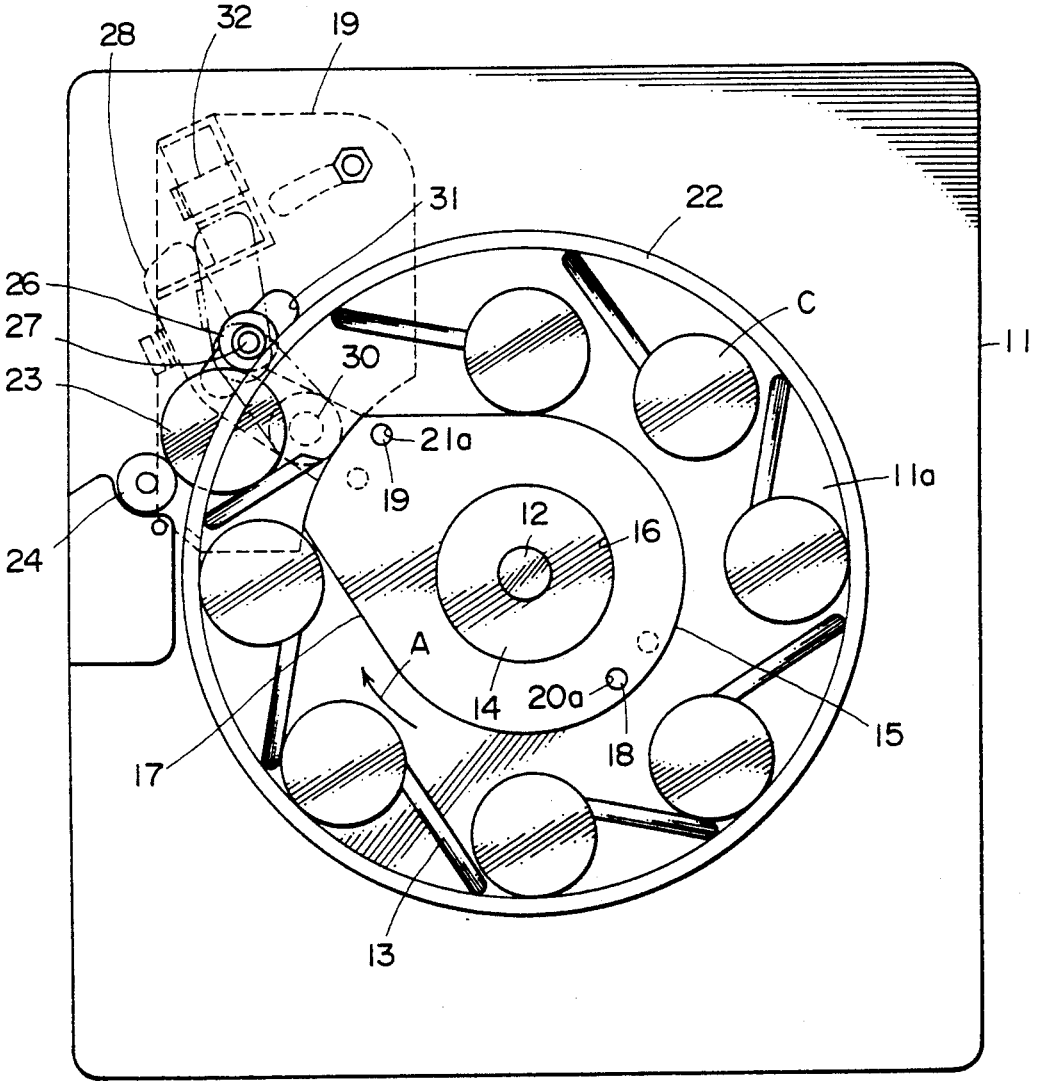
FIG. 4 is a schematic view illustrating a coin feeding operation.

The coin feeding rotary disk 2 has a thick disk body 3 and a circumferential wall 4 which is integrally formed with the disk body 3 in the form of a pan. The disk body 3 is provided with a plurality of, for example eight circumferentially spaced coin receiving through holes 5 which has a depth receiving five coins. The circumferential wall 4 is provided on the inner surface 4*b* with coin agitating protrusions 6 at positions between the coin receiving holes. The coin agitating protrusions 6 are inwardly inclined from the top end 4*a* to the lower end of the circumferential wall 4. The coin feeding rotary disk 2 is provided on the bottom surface thereof with coin feeding arms 13, each of which has a thickness smaller than the thickness of a coin to be treated, and extends from the peripheral edge of the rotary disk 2 to at least a circle connecting centers of coin receiving through holes 5 at an angle to the radial direction of the rotary disk 2 on the peripheral portion of the bottom surface between the coin receiving through holes 5 of the rotary disk 2 as shown in FIG. 3.

The inclined base plate 11 is provided with a supporting circular stage 14 which is concentric with the central rotary shaft 12. The circular stage 14 has a thickness slightly larger than the thickness of a coin C to be treated. The coin feeding rotary disk 2 is rotatably supported on the circular stage 14, whereby one coin drops from the coin receiving through hole on the upper coin supporting surface 11*a* of the inclined base plate 11 between the coin feeding arms 13.

The inclined base plate 11 is also provided with a coin guiding elliptical plate 15 around the circular stage 14. The large diameter end portion has a central hole 16 which is rotatably fitted with the circular stage 14 so as to coincide the center of the large diameter end portion with the axis of the central rotary shaft 12.

The elliptical coin guide plate 15 has a linear guide portion 17 for guiding coins toward the coin outlet 23. The large diameter end portion and the small diameter end portion has a pin 18 and a pin 19, respectively planted therein to project from the surface of the guide plate 15 at the side of the inclined base plate 11, while the inclined base plate 11 is provided with a plurality of pin holes 20*a*, 20*b*. . . , 21*a*, 21*b* which are spaced apart along the arcs of the end portions of the elliptical coin guide plate to selectively receive the pins 18 and 19, respectively. Thus the elliptical coin guide plate 15 can be selectively set to change the position of the guide portion 17 in corresponding to a diameter of coin to be treated between a small coin guide position in which the pins 18 and 19 are inserted in the pin holes 20*a* and 21*a*, respectively, and a large coin guide position in which the pins 18 and 19 are inserted in the pin holes 20*b* and 21*b*, respectively.

Figure 2:
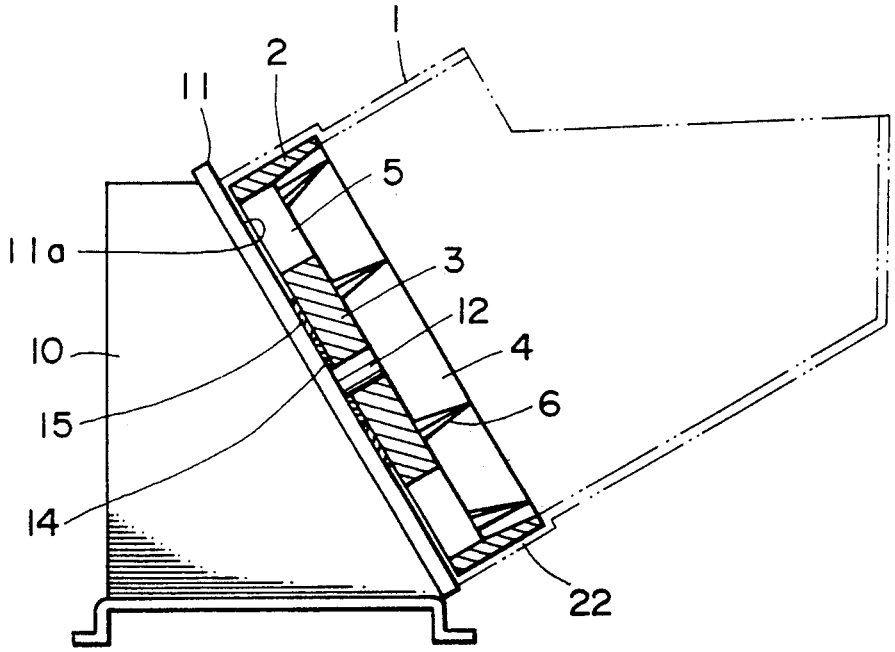
FIG. 2 is a schematic sectional view of the illustrative coin dispensing apparatus of FIG. 1.

The coin supply hopper 1 has a cylindrical lower portion 22 (FIG. 2) which is fixed to the inclined base plate 11 around the coin feeding rotary disk 2 having the circumferential wall 4 and is provided with a coin outlet 23 opened at the downstream side of the coin outlet guide portion 17 of the coin guide plate 15.

At the upstream side of the coin outlet 23, a fixed guide roller 24 is rotatably supported on a roller shaft 25 fixed to the base plate and at the downstream side of the coin outlet 23, a movable guide roller 26 is rotatably supported on a roller shaft 27 secured to a rockable actuator 28 of an outlet sensor.

The outlet sensor actuator 28 is pivotably secured to a bracket 29 by a pivot pin 30 fixed to the base plate 11 at the rear side thereof and normally retained in unoperation position shown in a broken line by means of spring (not shown). The roller shaft 27 of the movable guide roller 26 is extended through an arched groove 31 formed in the base plate 11. A count sensor 32 is secured to the bracket 27 such as to be operated by the actuator 28 which is pushed against a spring force (as shown by a chain line) through the movable guide roller 26 by a coin passing the coin outlet 23.

In the coin dispensing operation, the coin feeding rotary disk 2 is rotated in the direction shown by arrow A about the central rotary shaft 12 within the coin supply hopper 1 by means of a motor and then coins within the hopper 1 are agitated by the agitating protrusions 6 on the inner surface of the circumferential wall 4 and enter the coin receiving through holes 5 in the disk 2. Each of coin receiving through holes 5 can hold five coins so that at least one coin is always maintained in the through hole even if the coin feeding rotary disk is rotated at a very high speed.

The coins sequentially pass through the holes 5 downwardly and one coin is always supported on the coin supporting surface in each space between the sequential coin feeding arms. Thus one coin is fed in the direction shown by the arrow A by each of the coin feeding arms 13 and guided toward the coin outlet 23 by the coin outlet guiding portion 17 of the guide plate 15. Finally, the coin is guided by the coin outlet guiding portion 17, the fixed guide roller 24 and the movable guide roller 26 and pushed out the coin outlet 23 by the coin feeding arm 13. At this time, the movable guide roller 26 is pushed by the coin to rotate the actuator 28 and the sensor 32 counts the dispensed coin.

What is claimed is:

1. A coin dispensing apparatus comprising a coin supply hopper fixedly supported on a base plate inclined at an angle to the horizontal for storing a supply of coins in bulk and a coin feeding rotary disk rotatably supported on the base plate within the coin supply hopper, the coin feeding rotary disk having a disk body and a circumferential wall, the disk body including a plurality of circumferentially spaced coin receiving through holes extended through the peripheral portion of the coin feeding rotary disk and a plurality of coin feeding arms having a thickness smaller than the thickness of a coin to be treated and extending at an angle to the radial direction of the rotary disk on the peripheral portion of the bottom surface between the coil receiving through holes of the rotary disk, and the circumferential wall being provided on the inner surface thereof with a plurality of circumferentially spaced coin agitating protrusions.

2. The apparatus claimed in claim 1, wherein the disk body has a sufficient thickness to provide coin receiving through holes having a deep depth for holding at least three coins therein.

3. The apparatus claimed in claim 1, wherein the coin agitating protrusions on the inner surface of the circumferential wall are inwardly inclined and extend from the top to the lower end of the circumferential wall.

4. The apparatus claimed in claim 1, said apparatus further comprising a supporting circular stage provided on the inclined base plate for rotatably supporting the coin feeding rotary disk, the supporting circular stage being concentric with a central rotary shaft of the coin feeding rotary disk and having a thickness slightly larger than the thickness of a coin to be treated.

5. The apparatus claimed in claim 4, said apparatus further comprising an elliptical coin guide plate rotatably fitted around the supporting circular stage for guiding coins dropped on the inclined base plate through the coin receiving through holes, said elliptical plated having a larger diameter end portion having a center coincided with the central axis of the coin feeding rotary disk and a small diameter end portion opposed to a coin outlet formed in the coin supply hopper.

6. The apparatus claimed in claim 5, wherein the elliptical coin guide plate has a coin outlet guide portion for guiding coins to the coin outlet.

7. The apparatus claimed in claim 1 wherein the coin feeding arms are extended from the outer peripheral edge of the coin feeding rotary disk to at least a circle connecting centers of the coin receiving through holes.

* * * * *